United States Patent [19]

Barnes et al.

[11] Patent Number: 4,993,725

[45] Date of Patent: Feb. 19, 1991

[54] UNITARY SKATE ASSEMBLY HAVING VERTICAL SPRING MEANS

[75] Inventors: Frank S. Barnes; Norman W. Baer, both of Boulder, Colo.

[73] Assignee: University of Colorado Foundation, Inc., Boulder, Colo.

[21] Appl. No.: 508,329

[22] Filed: Apr. 11, 1990

[51] Int. Cl.[5] ..... A63C 1/24

[52] U.S. Cl. ..... 280/11.14

[58] Field of Search ..... 280/11.14, 11.12, 11.18, 280/11.15, 600, 9, 10

[56] References Cited

U.S. PATENT DOCUMENTS

| | | | |
|---|---|---|---|
| 22,895 | 2/1859 | Sanford | 280/11.14 |
| 27,137 | 2/1860 | Lovejoy | 280/11.14 |
| 36,595 | 10/1862 | Ansley | 280/11.14 |
| 37,428 | 1/1863 | Ansley | 280/11.14 |
| 48,950 | 7/1855 | Johnson, Jr. | 280/11.14 |
| 236,556 | 1/1881 | Cornell | 280/11.14 |
| 388,693 | 8/1888 | La Chaine | 280/11.14 |
| 689,851 | 12/1901 | Bustin | 280/11.14 |
| 838,623 | 12/1906 | King | 280/11.14 |
| 1,111,246 | 9/1914 | Button | 280/11.14 |
| 1,143,868 | 6/1915 | Tuller et al. | 280/11.14 |
| 1,245,737 | 11/1917 | King | 280/11.14 |
| 1,263,091 | 4/1918 | Miers | 280/11.14 |
| 1,263,093 | 4/1918 | Miers | 280/11.14 |
| 2,414,967 | 8/1945 | Meyers | 280/11.14 |

FOREIGN PATENT DOCUMENTS

| | | | |
|---|---|---|---|
| 15974 | 8/1902 | Sweden | 280/11.14 |

*Primary Examiner*—Charles A. Marmor
*Assistant Examiner*—Richard Camby
*Attorney, Agent, or Firm*—Francis A. Sirr; Earl C. Hancock

[57] ABSTRACT

A single blade ice skate is disclosed wherein the ice engaging blade, the toe boot plate and the heel boot plate are formed as a unitary assembly from a flat sheet of metal stock material, with the two boot plates being attached to the blade by way of twisted metal extension portions. In the initial flat state, the blade portion, the two extension portions and the two boot plates occupy a common physical plane. The two extension portions that connect the boot plates to the blade are then twisted 90° in this common plane, and in a manner to place the two boot plates in planes that are normal to the plane of the blade and normal to the common plane of the initial metal stock material. The two boot plates are then bent into a U-shape, so as to provide a U-shaped vertical spring member for each of the boot plates, the spring member acting between the two boot plates and the blade (i.e. a spring member operating in the vertical plane of the blade), while at the same time providing a rigid lateral connection between the plane of the two boot plates and the plane of the blade, thereby rigidly maintaining these planes as normal planes during a skating maneuver.

34 Claims, 4 Drawing Sheets

UNITARY SKATE ASSEMBLY HAVING VERTICAL SPRING MEANS

FIELD OF THE INVENTION

This invention relates to the field of runner or blade type skates having resiliently mounted boot plates or shoe attachment means, and more particularly to blade type skates wherein a single ice engaging blade and two boot plates are formed as a unitary assembly from a flat sheet of metal stock, without the use of attachment means such as welding and the like.

BACKGROUND OF THE INVENTION

In the art of figure skating on ice, a potential injury problem exists due to repetitive landings on the ice, which landings operate to stress the skater's ankles, knees, etc. One way to relieve the high deceleration forces that accompany many ice skating maneuvers is to place a spring between the skate boot and the ice engaging blade. This spring should bent or yield in the vertical direction only, and should be quite stiff and unyielding in the horizontal or lateral direction, thus providing the skater with good edge control. In addition, this vertical spring function should be provided in a manner so as not to weaken the mechanical strength of the skate blade assembly.

The present invention relates to a single blade ice skate that provides a vertical spring means, while maintaining a high degree of horizontal or lateral stability. In order to provide maximum strength for the blade/boot plate structure of the invention, with no localized areas of mechanical stress, the blade/boot plate structure of the invention is formed as a unitary assembly from a single piece of metal.

The concept of providing vertical spring means in a skate is generally known in the art. For example U.S. Pat. No. 2,414,967 teaches an ice skate wherein spring steel sole and heel plates are riveted to a blade. U.S. Pat. Nos. 22,895, 27,137, 236,556, 838,623, 1,245,737 and 1,263,091 are generally similar in their teachings.

In addition, it is known that coil springs have been used in the art to provide skates having a vertically operating spring means. U.S. Pat. Nos. 36,595, 37,428, 48,950, 388,693, 689,851, 1,111,246, 1,143,868 and 1,263,093 are examples.

While arrangements as exemplified above provided a form of vertical spring means, these arrangements all comprise a multiplicity of individual parts which must be fastened together to form an operating device. This construction inherently provides areas of metal stress and weakness, such as at the locations of fastening means such as welds or rivets. In addition, these arrangements do not provide a high degree of lateral stability for the skater.

Thus there remains a need in the art to provide an adequate vertical spring function to the skate, while at the same time maintaining a high degree of mechanical strength, with little or no sacrifice in the lateral stability that is provided to the skater.

SUMMARY OF THE INVENTION

This invention provides runner or blade type skates having resiliently mounted boot plates or shoe attachment means, wherein the ice engaging blade and two associated boot plates are formed as a unitary assembly from a flat sheet of metal stock. The invention provides a vertical spring means in the assembly without sacrificing structural strength. A high degree of lateral stability and control are provided to the skater.

The vertical spring means of the invention not only protects the skater from vertical shock, but also provides a spring board effect and additional forward trust to the skater when executing certain maneuvers.

More specifically, the present invention provides a pair of single blade ice skates having metal ice engaging blades which in use by a skater occupy generally vertical planes. Each of the two blades are attached to two metal boot plates that occupy one or two horizontal planes (depending upon the construction of the skate boot with which the blade assembly is used). The two boot plates are horizontally spaced from each other along the length of the blade.

The two boot plates are adapted for attachment to the sole of a skate boot, one boot plate being attached generally to the toe of the skate boot, and the other boot plate being attached generally to the heel of the skate boot. Within the spirit and scope of the invention, one or both of these boot plates may be somewhat curved, to thereby better conform to the sole of the skate boot.

As an initial step of the invention, the two boot plates and the blade are formed as a unitary assembly (i.e. no rivets, welding or the like are used) from a flat sheet of metal stock material. Both of the boot plates are connected to the blade by way of relatively narrow metal web portions. In this initial state, a flat composite metal member (comprising the blade portion, the two web portions and the two boot plate portions) occupy a common plane (herein sometimes called the X-Y plane). The general shape of this composite metal member is such that the two web portions, each having a boot plate at the end thereof, extend generally normal to the direction in which the blade extends.

All or portions of the composite metal member are now heated.

The two heated web portions are now quickly bent through about 90 degrees of rotation, and about axes that both lie in the above mentioned common plane and extend generally normal to the direction in which the blade extends.

This bending operation places the two boot plates in two physically spaced and parallel planes (herein sometimes called the Y-Z plane). The two boot plates now occupy two parallel planes that are spaced from each other along the length of the blade, these planes extending generally normal to the plane of the blade.

The two heated boot plates are now bent into a U-shape, and in a downward direction toward the blade, until the boot plates occupy one or two generally horizontal planes (again depending upon the skate boot construction) (herein sometimes called X-Z planes). This bending operation forms each boot plate into a generally U-shaped configuration which functions as a vertical spring means when the skate is in use.

The resulting unitary blade/boot plate assembly is now subjected to stress relieving and tempering techniques, such as heating followed by oil quenching.

The resulting unitary blade/boot plate member, by way of its bent metal portions, provides a vertical spring means that operates between the two boot plates and the blade. This spring means operates in the vertical plane of the blade, while at the same time providing rigid horizontal or lateral stability between the two boot plates and the blade. While vertical movement may occur between the boot plates and the blade, the boot plates and the blade are rigidly maintained in mutually perpendicular or normal planes.

An object of the invention is to provide a skate assembly having vertically operating spring means wherein the assembly does not make use of attachment means such as welds, rivets and the like.

An object of the invention is to provide a one-piece blade assembly having a vertically operating spring portion, wherein the blade assembly avoids the use of structure weakening attachment means such as welds, rivets and the like, and wherein the vertical spring function is provided without degrading lateral control of the blade by the user.

A further object of the invention is to form a one-piece metal blade assembly wherein two boot attaching plates are twisted and bent into an operating position in a manner that provides a vertically operating spring for one or both of the boot attaching plates.

As a feature of the invention, a spring stiffening wall member may be movably located so as to allow the spring rate of the vertical spring means to be adjusted to suit the needs of the skater. In order to provide protection to the skater from excessively high vertical forces while skating, this wall member can be formed of a crushable plastic or foam, or it can be formed as an air filled shock absorber.

As a further feature of the invention, the vertical spring means of the invention is provided by bent metal portions that are formed from the boot plates. In order to adjust the spring rate of these vertical spring means, these bent portions may be reduced in thickness, as by belt grinding, to thereby control or tune the spring rate of the vertical spring means to the needs of an individual skater.

These and other objects and advantages of the invention will be apparent to those of skill in the art upon reference to the following detailed description of the invention, which description makes reference to the drawing.

DETAILED DESCRIPTION OF THE INVENTION

The present invention comprises a blade skate wherein an ice engaging blade and boot plates are formed from one unitary piece of metal, and includes metallic vertical spring portions that interconnect at least one of the boot plates to the blade.

Figure 1:
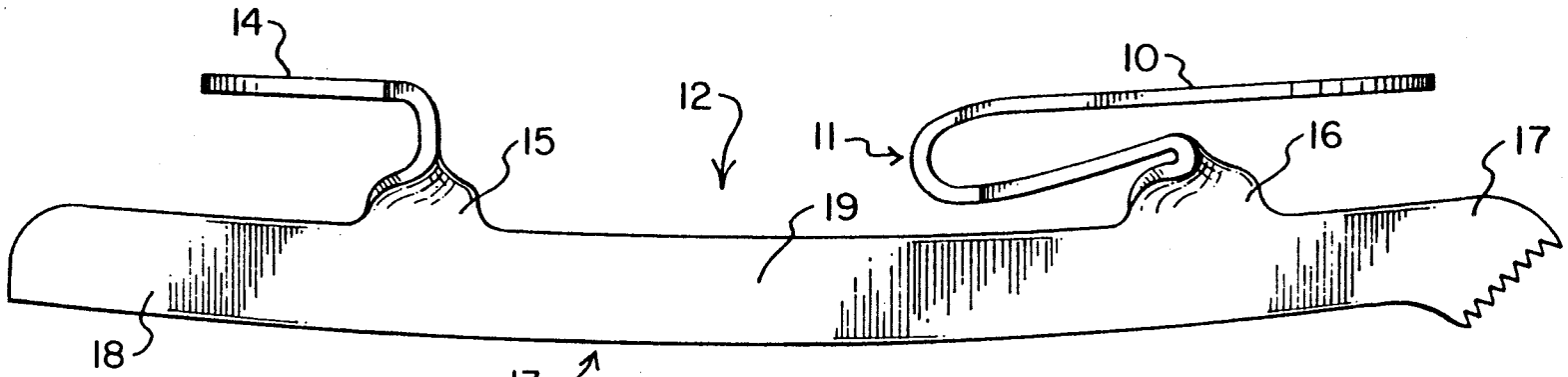
FIG. 1 is a perspective view of a first embodiment of a blade skate in accordance with the invention wherein only the toe boot plate thereof includes a vertically operation spring means, and showing a unitary metal member that includes an ice engaging blade, a heel boot plate, and a toe plate that is connected to the blade by way of metallic U-shaped spring means.

In the embodiment of the invention shown in FIG. 1 only toe boot plate 10 includes a vertically operating spring means 11 formed within unitary metal member 12, metal member 12 also including ice engaging blade 13 and heel boot plate 14.

In order to simplify the showing of the various embodiments of the invention, the skate boot with which a blade assembly in accordance with the invention is associated will not be shown. It is to be understood however that the toe and heel plates thereof, such as 10,14, are all adapted, in a well known manner, for attachment to, or for embedding in, the heel and toe portions of a skate boot. Some skate boots are constructed and arranged such that boot plates 10,14 occupy a common horizontal plane. Other skate boots are constructed such that, for example, heel plate 14 is at a higher plane than toe plate 10. In addition, plates 10,14 may not be flat, but may be shaped to conform to the requirements of the skate boot. All such variations are to be considered as within the spirit and scope of the invention.

The type of metal to be used as the unitary metal member 12 of this and other embodiments of the invention is quite variable, and consists generally of all high alloy tool steels. Metals such as these are fatigue resistant and are less subject to crystal failure with extended use, and they are heat treatable.

While the size configuration of embodiments of the invention, such as FIG. 1, are not critical to the invention, the bent metal web portions 15 and 16 that operate to connect and support heel plate 14 and toe plate 10 relative to blade 13 are located generally such that forward extending blade portion 17 and rearward blade portion 18 are of about equal length, and middle blade portion 19 is not over about $1\frac{1}{2}$ times the length of either of the blade portions 17,18.

As will be apparent to those of skill in the art, the embodiment of the invention shown in FIG. 1 provides a vertical spring 11 for only toe plate 10.

Within the teachings of the invention, it may be desirable to provide a vertical spring means at the location of both the toe and the heel of the skate. Such an embodiment of the invention is shown in FIGS. 2–4.

Figure 4:
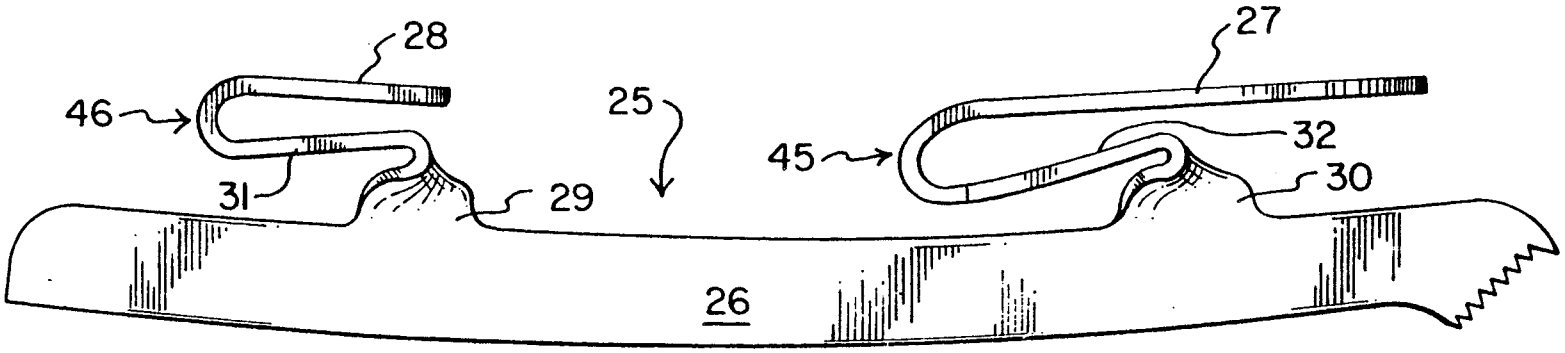
FIG. 4 is a view of the metal member of FIG. 3 after the boot plate portions thereof have been bent downward toward the blade, to thus form integral U-shaped vertical spring means for each of the boot plates, and to thus form the finished arrangement of this embodiment of the invention.
Figure 2:
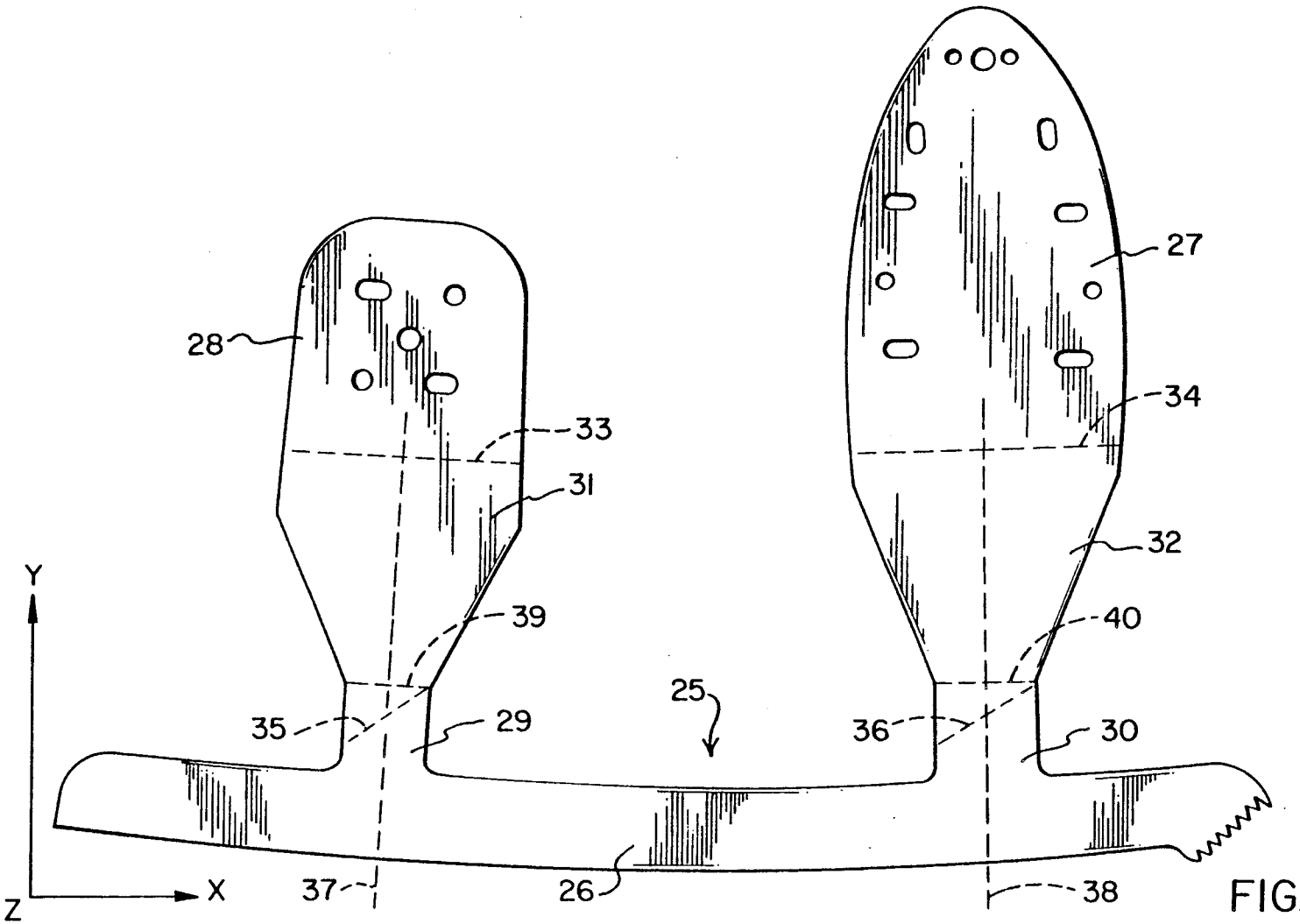
FIG. 2 is a plan view of a flat, unitary, metal member out of which the FIG. 4 embodiment of the invention will be formed, this metal member being formed or cut out of a single piece of metal, and showing all portions of the metal member occupying a common X-Y plane, i.e. the plane of the figure.
Figure 3:
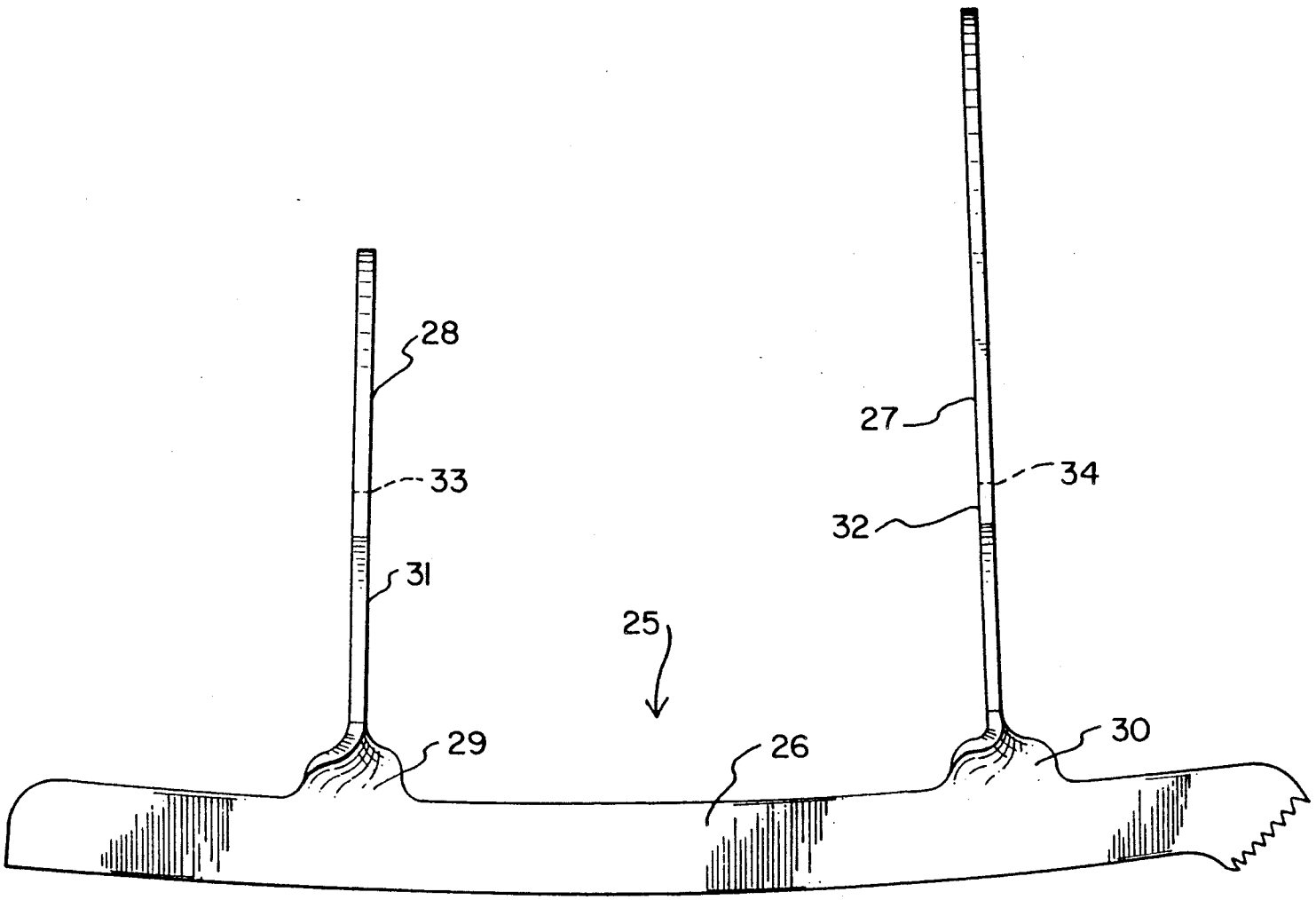
FIG. 3 is a view of the metal member of FIG. 2 after the boot plate portions thereof have been bent through an angle of about 90° by virtue of the twisting of the metal web portions that connect the boot plates to the blade.

FIG. 2 is a plan view of a flat, unitary, metal member 25 out of which the FIG. 4 embodiment of the invention will be formed. Metal member 25 is formed or cut out of a single, flat, relatively larger, piece of metal (not shown), for example a sheet of metal about 3.0 mm thick.

FIG. 2 contains a three orthogonal axis reference system, made up of axes X, Y and Z, that will be used to explain features of the invention. In FIG. 2, all portions of metal member 25 occupying a X-Y common plane, i.e. the plane of the figure.

As clearly seen in this figure, the formation of unitary metal member 25 by the use of any of a number of well known means such as stamping, laser cutting, EDM or numerical controlled milling, produces a flat metal member of generally uniform thickness (where thickness is measured in the Z direction normal to the plane of the figure). The individual parts of member 25 comprise blade 26 whose bottom surface will later be adapted for ice engagement, toe plate 27, heel plate 28, relatively narrow web portions 29 and 30 that connect plates 28 and 29, respectively, to blade 26, and portions 31 and 32 that will underlie heel plate and toe plate 27, respectively, when metal member 25 is later bent in the area indicated by dotted lines 33,34 and 39,40, as will be described. For example, dotted line 34 of FIG. 2 generally corresponds to spring means 11 of FIG. 1. Bend lines 33,34 and 39,40 extend generally parallel to the X axis.

Within the spirit and scope of the invention, the ice engaging portion of blade 26 may be coated with a wear resistant material such as diamond, silicon carbide, or the like, in order to reduce the number of times that the blade must be sharpened as a result of use by a skater.

The oblique dotted lines 35 and 36 of FIG. 2 indicate the manner in which the two web portions 35,36 of member 25 will be twisted about axes 37,38, respectively, as will be described. Axes 37,38 are parallel axes that lie within the X-Y plane of member 25 and extend generally parallel to the Y axis.

While not critical to the invention, toe and heel plates 27,28 include a number of openings therein to facilitate the positional adjustment, and then the semipermanent attachment, of these plates relative to a skate boot.

The next step in the production of a blade/boot plate assembly in accordance with the invention is to heat metal member 25 of FIG. 2 to its forging temperature. Once this has been accomplished, blade 26, boot plate portion 28,31 and boot plate portion 27,32 are held in a generally flat state as the two boot plate portions 28,31 and 27,32 are quickly twisted 90° about axes 37,38.

The result is shown in FIG. 3, i.e. a view of metal member 25 after boot plate portions 28,31 and 27,32 thereof have been bent through an angle of about 90° by virtue of the twisting of the metal web portions 29,30 that connect the boot plate portions to blade 26. As can be seen in FIG. 3, boot plate portions 28,31 and 27,32 now occupy parallel Y-Z planes that extend normal to the X-Y plane of blade 26. Bend lines 33,34 and 39,40 (FIG. 2) now lie in the Y-Z plane and extend generally parallel to the Z axis.

As the next step in the production of a blade/boot plate assembly in accordance with the invention, the metal member 25 of FIG. 3, which is still at its forging temperature, is bent about lines 33,34 and 39,40 (FIG. 2) to form the spring means 45,46 of FIG. 4 for the two boot plates 27,28, respectively.

More specifically, and with reference to FIG. 3, boot plate portions 28,31 and 27,32 are bent about bend lines 39,40, respectively, through an angle of about 90° in a clockwise direction. Thereafter, boot plate portions 28 and 27 are bend about bend lines 33 and 34, respectively, through and angle of about 180° in a clockwise direction.

The result is shown in FIG. 4, i.e. a view of metal member 25 of FIG. 3 after boot plate portions 28,31 and 27,32 thereof have been bent downward toward blade 26, to thus form integral U-shaped vertical spring means 45,46 for each of the boot plates, and to thus form the finished shape configuration of a skate blade arrangement in accordance with this embodiment of the invention.

Within the teachings of the invention, the horizontal X-Z planes occupied by members 27, 28, 31 and 32 may be four different but parallel X-Z planes, or some of these members may occupy a common X-Z plane.

As the final step in this process, the unitary blade/-boot plate assembly of FIG. 4 is subjected to stress relieving and tempering techniques, such as heating the assembly, followed by oil quenching. Without limitation thereto, the assembly is thereby provided with a hardness of about 45 Rockwell C.

The resulting unitary blade/boot plate member 25, by way of its bent metal portions 45,46, provides a vertical spring means that operates between the two boot plates 27,28 and blade 26. This spring means operates in the vertical Y direction within the X-Y plane of blade 26, while at the same time providing rigid horizontal or lateral (i.e. Z direction) stability between boot plates 27,28 and blade 26. While vertical movement may occur between boot plates 27,28 and blade 26, the boot plates and the blade are rigidly maintained in mutually perpendicular or normal planes (i.e. in the perpendicular X-Z and X-Y planes).

Figure 5:
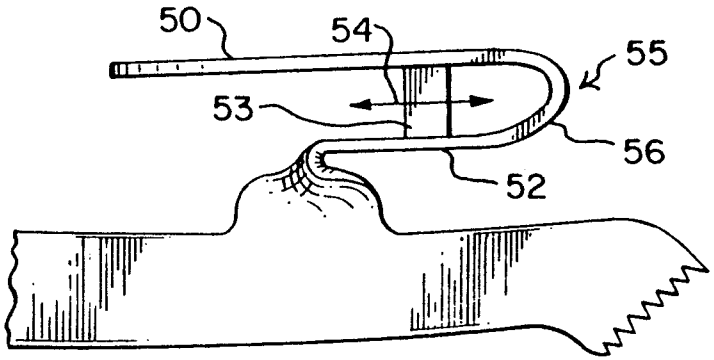
FIG. 5 is a view showing of an additional embodiment of a blade skate in accordance with the invention having a movable wall member to facilitate adjustment of the spring rate of the vertical spring means.

The shape of the bend that forms an integral vertical spring means in accordance with the invention is not critical. For example, bend 56 may be formed to point in the forward skating direction as is shown in FIG. 5. In this embodiment of the invention the bent spring portion 55 includes a relatively longer toe plate 50 and underlying portion 52.

Within the spirit and scope of the invention, either one or both of the boot plates may include the U-shaped vertical spring means of the invention, and the U-shape of these individual spring means may point in either the forward skating direction or in the reverse direction.

As a feature of the invention, an adjustable spring stiffening wall member 53 is movably located (see arrow 54) so as to allow the spring rate of vertical spring means 55 to be adjusted to suit the needs of the skater. That is, as wall member 54, which may comprise a flexible elastomer, is wedged in between members 50 and 52 at a greater distance from bent portion 56, vertical spring 55 becomes a stiffer spring. An additional advantage of the use of a spring stiffener such as wall member 54 is that the individual toe and heel spring rates for both feet can be individually adjusted to suit the needs of the skater.

In order to provide protection from excessive vertical force while skating, member 53 can be formed of a crushable plastic or foam, or member 54 can be formed as an air filled shock absorber.

As a further feature of the invention, the bent portions of the boot plates, such as 56 of FIG. 5, may be reduced in thickness, as by belt grinding, to thereby control or tune the spring rate of the vertical spring means to the need of an individual skater. Preferably this grinding operation is performed after the blade/-boot plate assembly has been tempered, and it is performed in a manner that does not appreciably heat the metal.

Figure 6:
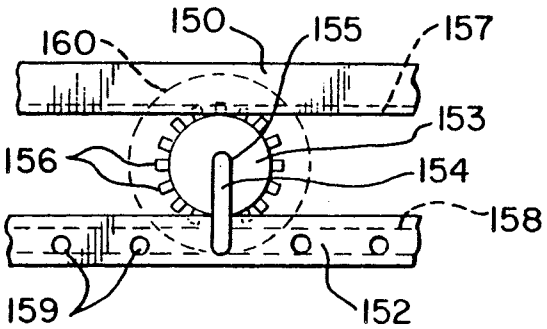
FIG. 6 is a partial view of an additional embodiment of the FIG. 5 construction wherein the movable wall member comprised a roller that can be rolled horizontally to a spring rate adjusting position, relative to the upper boot plate and relative to the underlying plate, the roller then being locked in position by the use of a removable U-shaped pin.

An exemplary way of implementing wall member 53 of FIG. 5 is shown in FIG. 6, i.e. a construction wherein the movable wall member comprised a roller 153 that can be rolled horizontally to any one of a number of spring rate adjusting position, relative to the upper metal boot plate 150 and relative to the underlying metal plate 152, the roller then being locked in position by the use of a removable U-shaped pin 154.

In this construction, roller 153 comprises a circular cylinder whose horizontal central axis extends normal to the plane of the figure, and coincides with a horizontal opening 155 that is formed in the center of roller 153 to accept the upper leg of metal pin 154. Roller 153 is provided with one or more gear teeth rings 156 that encircle the roller in a plane that is normal the the roller's central axis, i.e. the plane of gear ring(s) 156 is parallel to the plane of the figure. The two metal plates 150,152 are provides with mating gear teeth or clearance channels 157,158 that cooperate with each of the gear ring(s) 156 carried by roller 153. For example, 158 comprises an elongated channel that extends parallel to the plane of the figure and contains gear teeth to mate with gear ring 156, whereas 157 comprises an elongated channel that extends parallel to the plane of the figure, lies in the same vertical plane as channel 158, and consists of an open channel to provide clearance for gear ring 156. One of the metal members 150,152 (in this case member 152) is provided with a horizontal line of openings 159 to receive the lower horizontal leg of pin 154, to thereby lock roller 153 in one of a number of different spring rate adjusting positions.

If desired, roller 153 may be provided with a hand operated knob 160, at one or both axial ends of the roller, to facilitate adjustment of roller 153 in a horizontal direction between plates 150,152.

As will be appreciated by those of skill in the art, the present invention finds utility in various types of skates, of which figure skates, hockey skates and speed skates are three examples. Since the skating characteristic requirements for these various type skates are quite different, it is convenient to build a number of different test models in order to iteratively find the most desired material and/or configuration for a given type of skate, or for an individual skater who will use the given type of skate. After this most desired material and configuration are found, then perhaps a unitary device such as FIGS. 1 or 4 can be mass produced.

Figure 7:
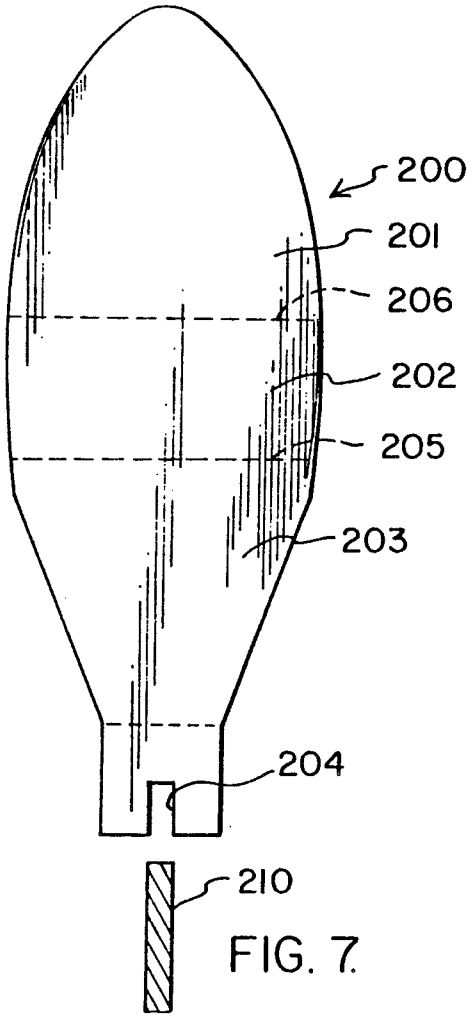
FIG. 7 is a plan view of a flat, unitary, metal member, somewhat similar to that of FIG. 2, out of which a toe plate and its underlying portion is formed, this metal member being adapted to be welded to a blade portion, this assembly being useful to test various metals, bend configurations, and the like, prior to mass producing metal members of the FIG. 2 type.

FIG. 7 discloses a means for building such a test model. This figure is a plan view of a flat, unitary, metal member 200, somewhat similar to that of FIG. 2, out of which a boot plate 201 and its underlying portion 202 will be formed into a U-shaped spring (as shown at 55 in FIG. 5). Member 200 includes a web portion 203 that terminates in a U-shaped slot 204. Web portion 203 joints underlying portion 202 at bend line 205, and boot plate 201 joins underlying portion 202 at bend line 206.

After member 200 is bent about 90° about bend line 205 and about 180° about bend line 206, the thus bent assembly is welded to an elongated blade portion 210, shown in cross section in FIG. 7. It will be recognized that a second boot plate is also welded to blade portion 210, and this welded assembly is then attached to a skate boot. As state, one use of this assembly is to test various metals, metal thickness, bend configurations, and the like, prior to mass producing the unitary metal members of the FIGS. 1 and 4 type.

As is seen from the above detailed description of a number of embodiments of the invention, the invention provides a runner or blade type skate having boot plates or shoe attachment means that are vertically movable relative to the blade, this movement being controlled by a spring means that is integral with the blade and the boot plates. The blade, the boot plates and the spring means are formed as a unitary assembly from a flat sheet of metal stock. As a result, vertical springs are provided for the skater, structural strength is not sacrificed, and lateral stability and control are maximized for the benefit of the skater.

It will be appreciated that yet other embodiments within the spirit and scope of the invention will be apparent to those of skill in the art. Thus it is intended that the present invention be as defined in the claim hereof.

What is claimed is:

1. A blade/boot plate assembly arranged for attachment to a skate boot, comprising a unitary metal member having;

an elongated generally horizontal blade occupying a first plane, at least one boot plate means having a first generally horizontal portion thereof located above said blade and occupying a second plane that extends normal to said first plane, and said boot plate means including a second generally horizontal portion thereof that is located generally below said first portion and is connected to said first portion through a U-shaped bend that extends generally parallel to said second plane and normal to said first plane, and a vertically twisted metal portion connecting said second portion of said boot plate means to said blade.

2. The blade/boot plate assembly of claim 1 wherein said second portion of said boot plate means is located generally vertically below and generally parallel to said first portion of said boot plate means.

3. The blade/boot plate assembly of claim 2 wherein said first portion of said boot plate means includes means for attaching said first portion to a skate boot.

4. The blade/boot plate assembly of claim 3 wherein said first portion of said boot plate means includes means for attaching said first portion to a toe portion of a skate boot, and including second boot plate means having a first generally horizontal portion thereof located above said blade and occupying a second plane that extends normal to said first plane, said second boot plate means including a second generally horizontal portion thereof that is located generally below said first portion and is connected to said first portion through a U-shaped bend that extends generally parallel to said second plane and normal to said first plane, and said second portion of said boot plate means including means for attaching said second first portion to a heel portion of a skate boot.

5. The blade/boot plate assembly of claim 1 including a generally vertically extending wall member between said first and second boot plate portions, said wall member being movable in a horizontal direction to control the spring rate of said U-shaped bend.

6. The blade/boot plate assembly of claim 5 wherein said wall member is formed of an elastomer.

7. The blade/boot plate assembly of claim 6 wherein said second portion of said boot plate means is located generally vertically below and generally parallel to said first portion of said boot plate means.

8. The blade/boot plate assembly of claim 7 wherein said first portion of said boot plate means includes means for attaching said first portion to a skate boot.

9. The blade/boot plate assembly of claim 8 wherein said first portion of said boot plate means includes means for attaching said first portion to a toe portion of a skate boot, and including second boot plate means having a first generally horizontal portion thereof located above said blade and occupying a second plane that extends normal to said first plane, said second boot plate means including a second generally horizontal portion thereof that is located generally below said first portion and is connected to said first portion through a U-shaped bend that extends generally parallel to said second plane and normal to said first plane, and said second portion of said boot plate means including means for attaching said second first portion to a heel portion of a skate boot.

10. The blade/boot plate assembly of claim 9 wherein said wall member is crushable under a predetermined vertical force.

11. The blade/boot plate assembly of claim 1 wherein the thickness of said twisted metal portion is reduced to thereby control the spring rate of said U-shaped bend.

12. The blade/boot plate assembly of claim 11 wherein said second portion of said boot plate means is located generally vertically below and generally parallel to said first portion of said boot plate means.

13. The blade/boot plate assembly of claim 12 wherein said first portion of said boot plate means includes means for attaching said first portion to a skate boot.

14. The blade/boot plate assembly of claim 13 wherein said first portion of said boot plate means includes means for attaching said first portion to a toe portion of a skate boot, and including second boot plate means having a first generally horizontal portion thereof located above said blade and occupying a second plane that extends normal to said first plane, said second boot plate means including a second generally horizontal portion thereof that is located generally below said first portion and is connected to said first portion through a U-shaped bend that extends generally parallel to said second plane and normal to said first plane, and said second portion of said boot plate means including means for attaching said second first portion to a heel portion of a skate boot.

15. The blade/boot plate assembly of claim 1 including means associated with said U-shaped bend to control the spring rate of said U-shaped bend.

16. The blade/boot plate assembly of claim 15 wherein said spring rate control means comprises a generally vertically extending wall member between said first and second boot plate portions, said wall member being movable in a horizontal direction to control the spring rate of said U-shaped bend.

17. The blade/boot plate assembly of claim 16 wherein said spring rate control means comprises a roller member extending between said first and second boot plate portions, said roller having a gear tooth ring encircling the roller, one of said first and second boot plate portions having a mating area of elongated gear teeth, and the other of said first and second boot plate portions having a mating area providing clearance for said gear teeth ring, and means for locking said roller in an adjusted horizontal position relative to said first and second boot plate portions.

18. A method for producing a unitary blade/boot plate assembly from a unitary metal member, comprising the steps of;

providing a flat, sheet-like metal member occupying an X-Y plane, shaping said metal member to form (1) an elongated blade portion that extends generally in an X direction within said X-Y plane, (2) at least one boot plate means located in a Y direction within said X-Y plane and above said blade portion, said boot plate means including an upper and a lower portion that join at a first bend line that extends in an X direction within said X-Y plane, and (3) a web portion connecting the lower portion of said boot plate means to said blade portion and extending in a Y direction within said X-Y plane, said web portion joining said lower portion of said boot plate means at a second bend line that is generally parallel to said first bend line and extends in an X direction within said X-Y plane, twisting said web portion about an axis that extends in a Y direction within said X-Y plane, so as to cause said first and second bend lines to extend in a Z direction within a Y-Z plane that is perpendicular to said X-Y plane, forming a bend of about ninety degrees at said second bend line, and forming a U-shaped bend of about one hundred eighty degrees at said first bend line, to thereby place said upper and lower portions of said boot plate means one above the other, with said lower portion being adjacent to said blade.

19. The method of claim 18 wherein said first portion of said boot plate means includes means for attaching said first portion to a skate boot.

20. The method of claim 19 including the step of providing a wall member extending between said first and second boot plate portions, said wall member being movable in an X direction within said X-Y plane to thereby control the spring rate of said U-shaped bend.

21. The method of claim 20 wherein said wall member is yieldable under a predetermined vertical force.

22. The method of claim 19 including the steps of providing a roller member extending between said first and second boot plate portions, said roller member being movable in an X direction within said X-Y plane to thereby control the spring rate of said U-shaped bend, and providing means to lock said roller member in position to which it is moved.

23. The method of claim 18 including the step of reducing the thickness of said one hundred eighty degree bend portion to thereby control the spring rate of said U-shaped bend.

24. The method of claim 18 wherein said step of shaping said metal member forms a first boot plate located above said blade portion for attachment to the toe portion of a skate boot, and forms a second boot plate located above said blade portion for attachment to the heel portion of a skate boot.

25. The method of claim 18 including the step of coating said elongated blade portion with a wear resistant material.

26. The method of claim 18 wherein prior to the production of a unitary blade/boot plate assembly in accordance with the steps of said method, one or more test models are fabricated by operation of a pre-method, the pre-method comprising the steps of, providing a first flat, sheet-like metal member and shaping said first metal member to form an elongated blade portion, providing a second flat, sheet-like metal member and shaping said second metal member to form a boot plate means including an upper generally horizontal portion and a lower generally horizontal portion that join at a first bend line, and having a web portion connected to the lower horizontal portion of said boot plate means and extending downward therefrom, said web portion terminating in a blade-receiving slot, and mounting the slot of said web portion onto said blade portion by the use of a welding attachment means or the like.

27. A blade/boot plate assembly arranged for attachment to a skate boot, comprising;

a unitary metal member having a boot plate portion that extends in a generally horizontal direction, said boot plate portion being integrally connected to a second generally horizontal portion by way of a generally 180°, U-shaped spring bend, said second portion then underlying said boot plate portion, and a generally vertically extending web portion integrally connected to said second portion of said unitary metal member by way of a generally 90° bend, said web portion then extending in a generally vertical downward direction and underlying said second portion of said unitary metal member, and said web portion terminating in an lower end portion, a U-shaped generally vertical slot formed formed in said lower end portion, and having a generally horizontal width equal to a given thickness, an elongated generally horizontally extending blade located in said U-shaped slot and having a generally vertical thickness about equal to said given thickness, and weld means cooperating with said blade and said web portion to thereby attach said unitary metal member to said blade.

28. The blade/boot plate assembly of claim 27 including means to control the spring rate of said U-shaped spring bend.

29. The blade/boot plate assembly of claim 27 wherein the thickness of said U-shaped spring bend is selectively reduced, to thereby control the spring rate of said U-shaped spring bend.

30. The blade/boot plate assembly of claim 27 including a generally vertically extending wall member between said boot plate portion and said second portion of said unitary metal member, said wall member being movable in a horizontal direction to control the spring rate of said U-shaped spring bend.

31. The blade/boot plate assembly of claim 27 including a second unitary metal member having a boot plate portion that extends in a generally horizontal direction, said boot plate portion being integrally connected to a second generally horizontal portion by way of a generally 180°, U-shaped spring bend, said second portion then underlying said boot plate portion, and a generally vertically extending web portion integrally connected to said second portion of said unitary metal member by way of a generally 90° bend, said web portion then extending in a generally vertical downward direction and underlying said second portion of said unitary metal member, and said web portion terminating in an lower end portion, U-shaped generally vertical slot formed formed in said lower end portion, and having a generally horizontal width equal to a given thickness, and second weld means cooperating with said blade and said web portion to thereby attach said second unitary metal member to said blade.

32. The blade/boot plate assembly of claim 31 including means to control the spring rate of the U-shaped spring bend of said unitary metal member and of said second unitary metal member.

33. The blade/boot plate assembly of claim 31 wherein the thickness of the U-shaped spring bend of said unitary metal member and of said second unitary metal member are both selectively reduced, to thereby control the spring rate of said two U-shaped spring bends.

34. The blade/boot plate assembly of claim 31 including a generally vertically extending wall member between the boot plate portion and the second portion of said unitary metal member and said second unitary metal member, said wall members being individually movable in a horizontal direction, to thereby individually control the spring rate of the U-shaped spring bends formed in said unitary metal member and said second unitary metal member.

* * * * *